US005730019A

United States Patent [19]

Venäläinen

[11] Patent Number: 5,730,019

[45] Date of Patent: Mar. 24, 1998

[54] METHOD FOR STRAIGHTENING AN AUTOMOTIVE BODYSHELL AND STRAIGHTENING APPARATUS FOR IMPLEMENTING THE SAME

[75] Inventor: Olavi Venäläinen, Kuopio, Finland

[73] Assignee: Autorobot Finland KY, Kuopio, Finland

[21] Appl. No.: 735,493

[22] Filed: Oct. 23, 1996

Related U.S. Application Data

[63] Continuation of Ser. No. 216,829, Mar. 24, 1994, abandoned.

[30] Foreign Application Priority Data

Mar. 24, 1993 [FI] Finland ..... 931296

[51] Int. Cl.[6] ..... B21D 1/12

[52] U.S. Cl. ..... 72/305; 72/705

[58] Field of Search ..... 72/705, 308, 305

[56] References Cited

U.S. PATENT DOCUMENTS

| | | | |
|---|---|---|---|
| 3,149,660 | 9/1964 | Smith | 72/705 |
| 3,667,275 | 6/1972 | Hunnicutt . | |
| 3,691,817 | 9/1972 | Friend et al. | 72/705 |
| 3,835,692 | 9/1974 | Hoffman | 72/705 |
| 3,955,397 | 5/1976 | Meis | 72/705 |
| 4,574,613 | 3/1986 | Doughty | 72/705 |
| 4,761,984 | 8/1988 | Fuscaldo, Jr. | 72/705 |
| 4,848,132 | 7/1989 | Saroli | 72/705 |
| 5,101,654 | 4/1992 | Stevens . | |

FOREIGN PATENT DOCUMENTS 2109044 9/1971 Germany .

*Primary Examiner*—Lowell A. Larson

*Attorney, Agent, or Firm*—Cushman, Darby & Cushman IP Group of Pillsbury, Madison & Sutro LLP

[57] ABSTRACT

The present invention concerns a method for straightening the bodyshell of an automotive vehicle in a straightening jig, said method comprising fixing the bodyshell (1) to a straightening jig, moving a straightening boom (2) incorporated in the straightening jig to a proper position relative to the bodyshell, fixing at least two clamp tools (3) to the automotive bodyshell and to a pulling tool member (4) which is passed via a backing member (7) connected to a power actuator (6). Furthermore, the invention concerns a straightening apparatus comprising a straightening boom (2), a clamp tool (3) and a pulling tool member (4). Conventional apparatuses fail to provide equal force at the different points being pulled and are not capable of stopping the movement of a pulling tool member in a selected direction. In the method according to the invention, the pulling tool member (4) is adjusted to reach to the automotive bodyshell (1) from a desired angle with the help of guidance elements (5) attachable to the straightening boom at a desired height, and the pulling tool member (4) is locked in place by means of a locking device (8), while the pulling operation is continued by means of that section of the pulling tool member remaining on the opposite side.

8 Claims, 3 Drawing Sheets

Figure 1:
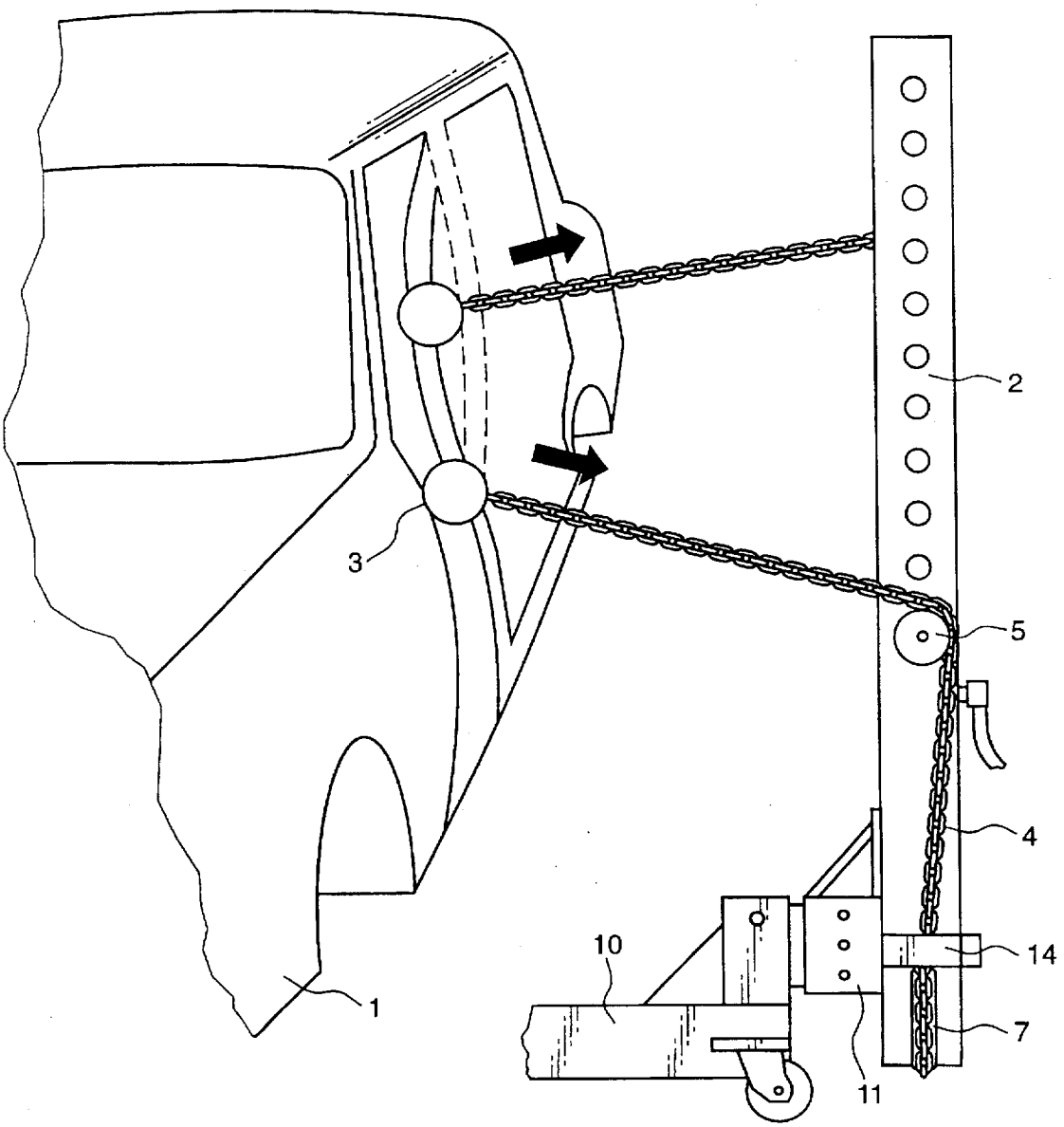

METHOD FOR STRAIGHTENING AN AUTOMOTIVE BODYSHELL AND STRAIGHTENING APPARATUS FOR IMPLEMENTING THE SAME

This is a continuation of application Ser. No. 08/216,829, filed on Mar. 24, 1994, which was abandoned upon the filing hereof.

The present invention relates to a method for straightening an automotive bodyshell, said method comprising fixing the automotive bodyshell to a straightening jig, moving a straightening boom incorporated in the straightening jig to a proper position relative to the automotive bodyshell, fixing at least two clamp tools to the automotive bodyshell and to a pulling tool member which is passed via a backing member connected to a power actuator, whereby at least two pulling forces acting at the same magnitude are imposed on the points being straightened. The invention is further related to a straightening apparatus suited for implementing said method, said apparatus comprising a straightening boom, at least two clamp tools and at least one pulling tool member suited to accommodate the connection of said clamp tool at the pulling tool member ends, and a power actuator for moving said pulling tool member(s) and clamp tool(s) attached thereto.

In conventional vehicle bodyshell straightening jigs the vehicle is driven or transferred over the straightening jig framework, after which the vehicle is attached with the help of clamping means to the framework and lifted to a desired elevation. The straightening boom of the jig is moved to a desired working location, the guidance elements are fixed at a desired elevation on the straightening boom, and the pulling tool member(s) is/are attached at desired points of the vehicle bodyshell. Finally, the power actuator is energized to apply a force to the pulling tool member(s) and clamp tool(s), thus pulling the vehicle bodyshell to a desired direction.

The pulling tool member is a chain or similar means, which generally is connected at its one end to a power actuator, a straightening boom or the framework of the straightening jig. To such a pulling tool member can be connected another pulling tool member, whereby the vehicle bodyshell can be pulled simultaneously by at least two clamp tools. Then, an equal force is imposed on the points being straightened, while with an unexpectedly faster straightening of one point over another may cause damage at one of the points owing to uneven or too fast pulling. Typically, one of the points on the distorted bodyshell assumes its desired straightening dimension faster than the other points. Then, the clamp tool attached to such a point must be disengaged or otherwise inactivated. This is clumsy and requires manual reaching to the pulled point, which is risky impairing the operator's safety. Another drawback of conventional straightening apparatuses is that the straightening boom cannot be extended with a satisfactory ease to the different points of the automotive bodyshell, but rather the straightening apparatus requires the use of a number of straightening booms located at different sides.

It is an object of the present invention to provide a method capable of overcoming the drawbacks of conventional straightening methods. A particular object of the invention is to provide a method characterized by automatic self-adjustment of the pulling operation and continuous equalization of pulling force at at least two points being pulled. A further object of the invention is to provide a method capable of stopping in a rapid, simple and safe manner the movement of a pulling tool member in a selected direction and of reaching to the automotive bodyshell with the clamp tool from a desired direction. A still further object of the invention is to provide a straightening jig suited for implementing said method, which jig is automatically self-adjusting, easy to use and reliable in use.

The goal of the invention is achieved by providing a method and a straightening jig.

In the method according to the invention, the pulling tool member and the clamp tools connected to it are adjusted to reach to the automotive bodyshell from a desired direction with the help of guidance elements attachable separately to the straightening boom at a desired height, and the pulling tool member is locked in place by means of a locking device placed to one side of the power actuator on the straightening boom, while the pulling operation is continued by means of that section of the pulling tool member remaining on the opposite side. In the method according to the invention, the pulling tool member is initially bidirectionally movable on the backing element, or supported by it. Thus, the pulling tool member is used without being permanently fixed to the power actuator, the straightening boom or other straightening apparatus. To both ends of the pulling tool member are connected clamp tools for clamping to the pulling points on the automotive bodyshell. By virtue of the invention, the clamp tools can be arranged to reach from the straightening boom to the automotive bodyshell from different heights and different directions, thus providing optimal orientation of the pulling force working on each individual pulled point of the bodyshell.

When the backing element is moved by means of the power actuator, both ends of the pulling tool member are displaced, thus working on the automotive bodyshell via the clamp tools so as to straighten the bodyshell in a desired direction. As one of the bodyshell points connected to one end of the pulling tool member via a clamp tool yields and straightens earlier than another point connected to the other end of the pulling tool member via another clamp tool, the pulling tool member is free to move toward the direction of the lesser resistance. Then, an equal force is automatically self-adjusted to work on both points being pulled. When one of the points being straightened reaches the desired target dimension of the straightening operation, the pulling tool member is locked immovable on that side and the pulling operation can be continued in a conventional manner by means of the pulling tool member section remaining on the other side and the clamp tool connected to it. The locking operation is facilitated easy, and the straightening boom can be readily provided with necessary locking arrangements at such a point which permits locking without safety hazard.

In a preferred embodiment of the invention, at least one clamp tool is connected by means of a second pulling tool member to a first pulling tool member. In this fashion a plurality of clamp tools can be attached to a plurality of points of the vehicle bodyshell, thus permitting the pulling of the bodyshell simultaneously in a plurality of different directions at equal forces using a single straightening boom only.

In another modified embodiment of the invention, the straightening boom is adapted orthogonally rotatable with respect to the boom base, which is mounted to the framework of the straightening jig, by means of a rotating actuator. In this embodiment of the invention, to the upper end of the straightening boom is attached a rotatable extension boom, which is then rotated to a desired direction with respect to the automotive bodyshell and then is fixed stationary in this direction by means of a locking member. By virtue of the extension boom, the working range of straightening boom can be made to reach to different points of a conventional automotive bodyshell merely by rotating the straightening boom to different directions. The straightening boom can then be permanently aligned at the side of the automotive bodyshell.

The power actuator used in the invention comprises a backing element capable of supporting the bidirectional movement of the pulling tool member, which has the clamp tools mounted at its both ends. Furthermore, the straightening apparatus incorporates a locking device placed in the vicinity of the power actuator to the end of locking the pulling tool member. Through this arrangement, the pulling forces are automatically self-adjusted according to the smallest of the pulling resistances at the different clamp points when the pulling tool member is being pulled by the power actuator, thus achieving optimal equalization of the pulling forces in each pulling operation. The apparatus has a simple construction and is easy to use.

Figure 2:
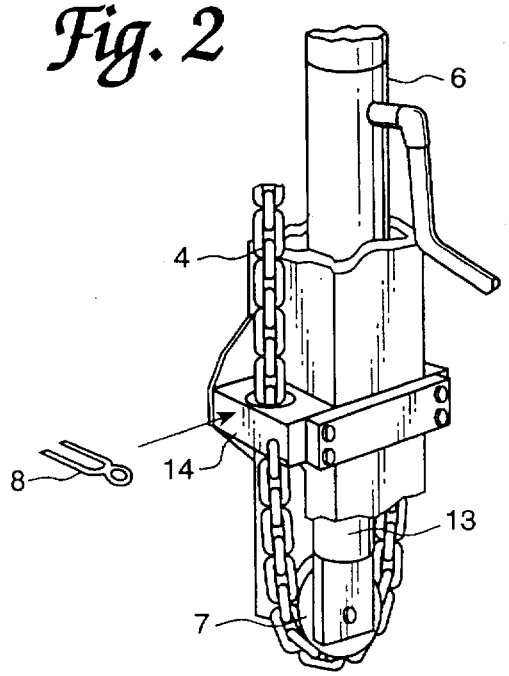
Figure 3:
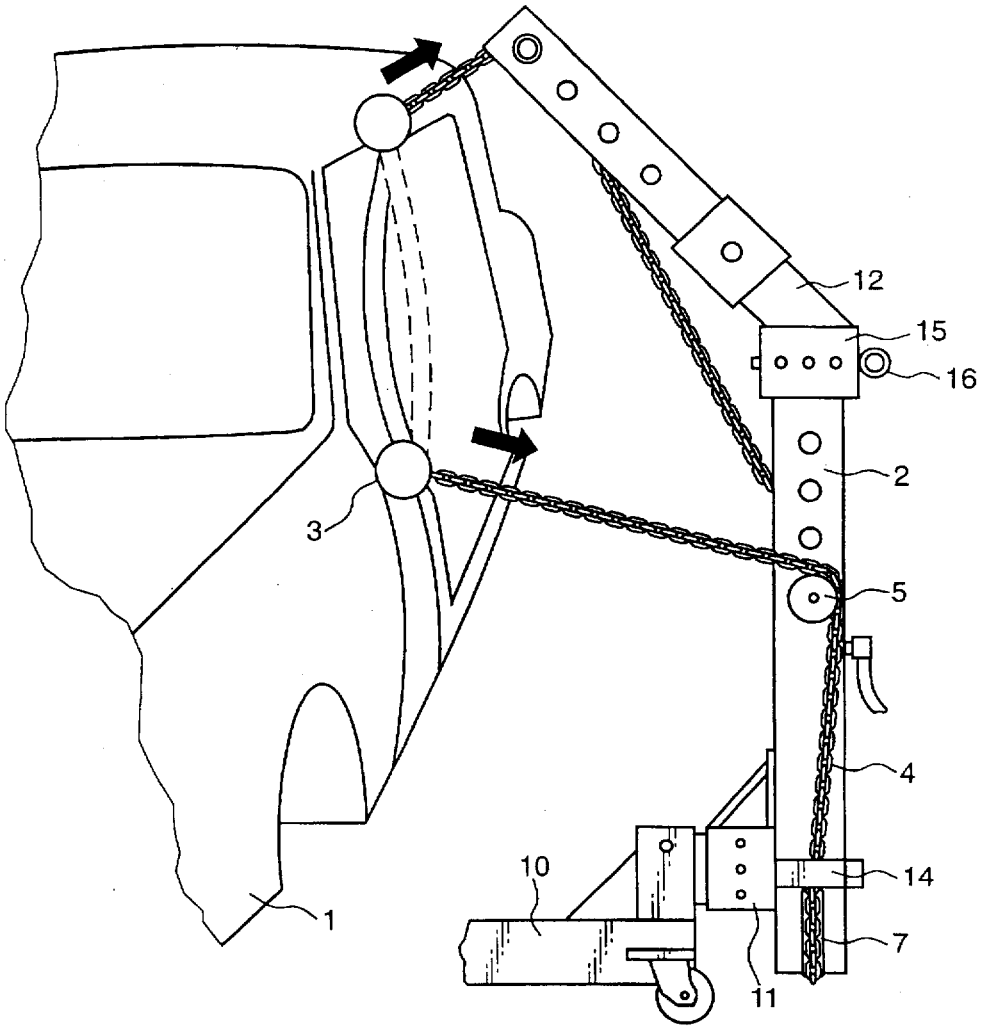
Figure 4:
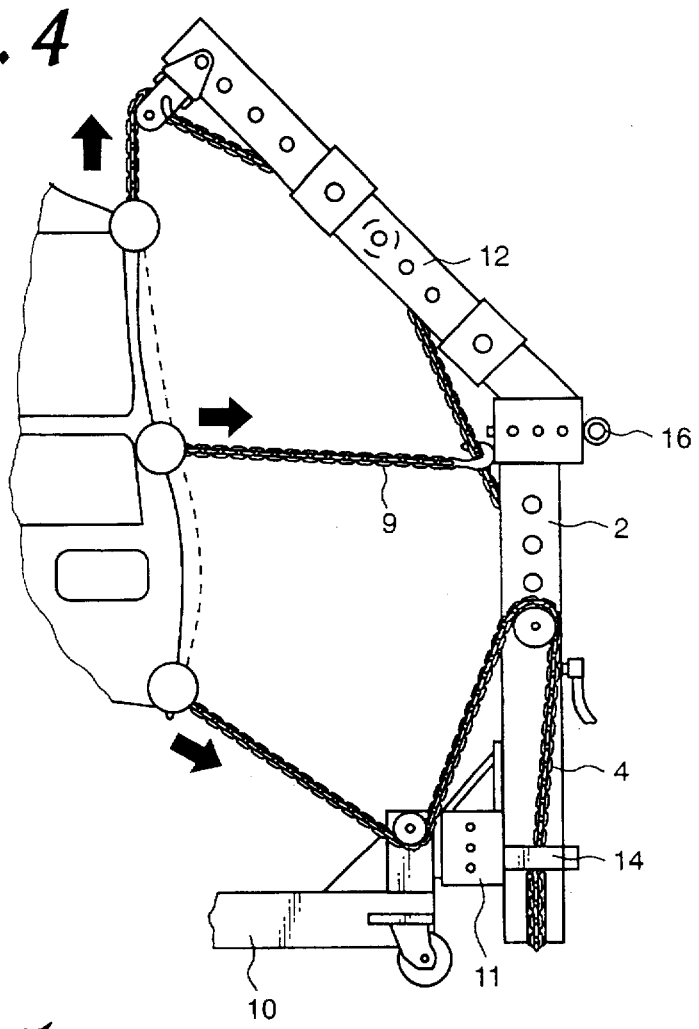
Figure 5:
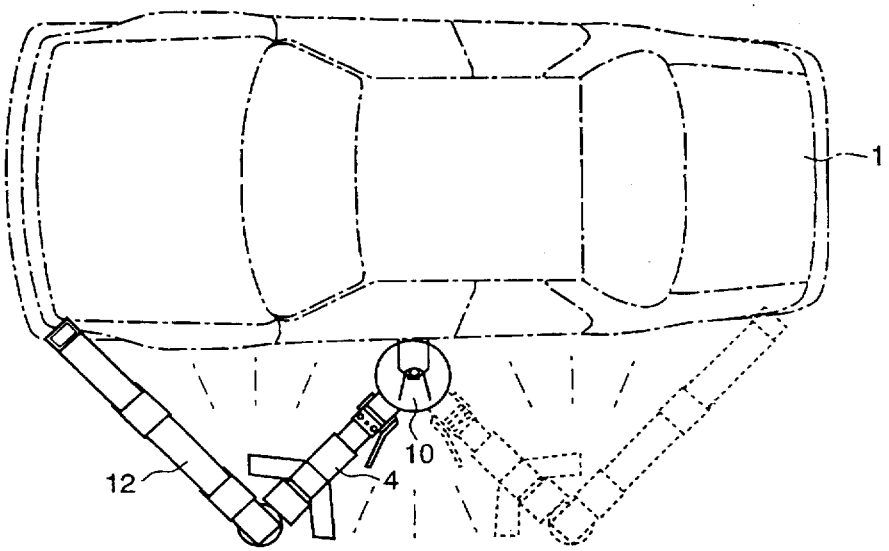

The invention is next examined with the help of the attached drawings, in which:

FIG. 1 is a side view of an embodiment of the apparatus according to the invention suited for implementing the method placed to the side of an automotive vehicle, FIG. 2 is an enlarged and partially sectional view of the lower end of the straightening boom of the apparatus illustrated in FIG. 1, FIG. 3 is a side view of another straightening boom embodiment for the apparatus according to the invention placed to the side of an automotive vehicle, FIG. 4 is a side view of a third straightening boom embodiment for the apparatus according to the invention placed to the side of an automotive vehicle, and FIG. 5 is a top view of the alternative possibilities of use for the straightening boom illustrated in FIG. 4.

With reference to the embodiment illustrated in FIGS. 1 and 2, the straightening apparatus comprises a boom base 10, suited for mounting onto the framework of the straightening apparatus, and a straightening boom 2 connected to the boom base. In a conventional manner, the straightening boom is connected to the boom base sideways rotatably by means of a rotating actuator 11. The straightening apparatus further incorporates clamp tools 3 and a pulling tool member 4 having the clamp tools connected to its ends, guidance elements 5 adjustably mountable on the straightening boom, and a power actuator 6. In the illustrated embodiment, the guidance elements 5 are guides which are detachably mounted in holes on the straightening boom and are suited for passing the pulling tool member over them, while other kinds of conventional arrangements can be alternatively used in different applications. The guidance elements are separate and can be placed on different sides of the straightening boom at different heights, or alternatively, at least two guidance elements can be placed on the same side of the boom at different heights. The structure of the clamp tools is not shown in detail in the diagrams as these can be any conventional clamping tools or elements suited to fulfill the required purpose. The power actuator is a hydraulic cylinder 6 disposed in the lower part of the straightening boom 2 having at the end of its piston rod 13 mounted a rotating element acting as a backing element 7. In the illustrated embodiment the rotating element is a sheave. The power actuator is adapted to the interior of the straightening boom so as to force the sheave directly downward, whereby the rear of the straightening boom is kept clear of any elements hampering the use of the apparatus. In the vicinity of the power actuator, to both sides of the straightening boom are disposed support blocks 14 having holes through which the pulling tool member is passed. The apparatus further incorporates locking devices 8 for locking the pulling tool member in place. The locking device can be, e.g., an element with a center hole, suited for placing about the chain used as the pulling tool member and suited for preventing the movement of the chain through the hole of the support block 14. The locking device can be varied in the different embodiments of the invention.

When using the straightening boom, the pulling tool member is passed via the rotating support element of the power actuator so as to rest against the surface of the element. The center section of the pulling tool member is approximately coincident with the power actuator, while both ends of the member are connected to the bodyshell. By virtue of the guidance elements, the ends of the pulling tool member and the clamp tools attached thereto can be connected to desired points of automotive bodyshell 1 so as to align the pulling force to a desired direction. During the pulling operation with the power actuator, both sections of the pulling tool member work with an equal force as described above.

With reference to FIG. 3, the apparatus illustrated in the diagram is similar to that shown in FIG. 1 with the exception that the upper end of the straightening boom has an extension boom 12 connected to it. The extension boom is rotatably mounted to the end of the straightening boom with the help of an adapter 15, and after alignment to a desired direction, is locked in place with the help of a locking member 16, which in the illustrated embodiment is a hairpin-shaped element.

With reference to FIG. 4, the embodiment of the apparatus illustrated in the diagram is principally similar to that shown in FIG. 3. In the embodiment shown herein, the end of the extension boom has further an extension arm 12 connected to it. Further, in this embodiment the pulling tool member 4 has a second pulling tool member 9 connected to it, which combination permits pulling at three different points. The pulling forces are oriented in the directions denoted by arrows in the diagram, whereby the apparatus achieves an extremely flexible straightening arrangement for an automotive vehicle bodyshell.

With reference to FIG. 5, the use of the apparatus illustrated in FIG. 4 is elucidated. In the arrangement shown herein, the apparatus is rotatable about the straightening boom in different positions, plus rotatable with the help of the rotating actuator sideways cross-wise with respect to the boom base, while the extension boom further can be rotated at different angles relative to the straightening boom. These facilities provide a wealth of orientations for the pulling tool member ends or the clamp tools, thus permitting proper alignment of the pulling force direction(s) relative to the automotive bodyshell in any circumstance. The apparatus is capable of reaching desired points of the automotive bodyshell at both its sides and top, and the boom base need not be moved between pulling cycles imposed on different points of the bodyshell.

The invention is not limited to the preferred embodiments described above, but rather, can be varied within the scope of the invention disclosed in the appended claims.

I claim:

1. A method for straightening a bodyshell of an automotive vehicle with a straightening jig, the jig including a straightening boom, extending vertically at least partially, at least two clamp tools constructed and arranged to be fixed to the bodyshell, at least one pulling tool member coupled at opposite ends respectively to the clamp tools and having first and second sections disposed on opposite sides of the boom, a power actuator for pulling on the one pulling tool member, guidance elements mounted adjustably on the boom at a desired height for guiding the one pulling tool member, support blocks on said opposite sides of the straightening boom, said one pulling tool member being passed through said support blocks, and a locking device for locking the one pulling tool member in a desired position with respect to said support blocks, the method including:

moving the boom to a position relative to the bodyshell, fixing the clamp tools to the bodyshell, adjusting the one pulling tool member and the clamp tools coupled therewith to reach the bodyshell from a desired angle by use of the guidance elements, operating the power actuator to perform a pulling operation adjacent the center of said one pulling tool member so that at least two pulling forces of generally the same magnitude are imposed on respective points of the bodyshell to be straightened, locking the first section of the one pulling tool member to an associated support block with the locking device; and continuing the pulling operation via the second section of the one pulling tool member.

2. A straightening apparatus for straightening a bodyshell of an automotive vehicle comprising:

a straightening boom extending vertically at least partially, at least two clamp tools constructed and arranged to the fixed to the bodyshell;

at least one pulling tool member having opposite ends respectively coupled to the clamp tools and having first and second connected sections disposed on opposite sides of the boom, a power actuator for pulling on the at least one pulling member near the center thereof with substantially equal pulling force being exerted on said two clamp tools, guidance elements mounted adjustably in a height direction of the boom on opposite sides of the boom for guiding said one pulling tool member, support blocks on opposing sides of the boom, said first and second sections of said one pulling tool member being passed through an associated said support block, and a locking device constructed and arranged to lock said first section of said one pulling tool member to an associated support block, after a corresponding one of said clamp tools has substantially straightened a portion of said bodyshell, said power actuator being operative thereafter to pull only on said second section of said one pulling tool member and a corresponding one of said clamp tools.

3. A straightening apparatus as defined in claim 2 wherein a second pulling tool member is provided and a third clamp tool is connected by means of the second pulling tool member to the first-mentioned pulling tool member.

4. A straightening apparatus as defined in claim 2, wherein first and second pulling tool members are provided and the second pulling tool member is detachably connected to said first pulling tool member.

5. A straightening apparatus as defined in claim 2, further comprising a backing member constructed and arranged to support bi-directional movement of the pulling tool member, the backing member being a rotating element connected to a piston rod of the power actuator.

6. A straightening apparatus as defined in claim 2 further comprising a boom base, said straightening boom being connected to the boom base in a sideways rotatable manner by means of a rotating actuator, and an extension boom is rotatably connected to an end of the straightening boom.

7. A straightening apparatus as defined in claim 6, wherein the straightening boom is adapted to be orthogonally rotatable with respect to a boom base which is mounted to a framework of the straightening jig by means of a rotating actuator, and wherein an end of the straightening boom is connected to a rotatable extension boom which is rotatable to a desired direction with respect to the automotive bodyshell and is lockable in place by a second locking device.

8. The straightening apparatus as defined in claim 2, wherein each of said support blocks has a hole therethrough with said first and second sections of said pulling tool member being passed through a hole in an associated said support block, and wherein said locking device comprises an element having spaced legs portions, said leg portions being constructed and arranged to be engaged with a portion of one of said first and second sections of said pulling tool member, thereby preventing movement of said pulling tool member through said hole.

* * * * *